United States Patent [19]

Krasnoff

[11] Patent Number: 4,707,952

[45] Date of Patent: Nov. 24, 1987

[54] LIQUID/ABRASIVE JET CUTTING APPARATUS

[75] Inventor: Eugene L. Krasnoff, Somerville, N.J.

[73] Assignee: Ingersoll-Rand Company, Woodcliff Lake, N.J.

[21] Appl. No.: 914,062

[22] Filed: Oct. 1, 1986

[51] Int. Cl.[4] ..... B24C 5/00

[52] U.S. Cl. ..... 51/410; 51/436; 51/439

[58] Field of Search ..... 51/410, 439, 436, 321, 51/319, 415

[56] References Cited

U.S. PATENT DOCUMENTS 2,985,050 5/1961 Schwacha ..... 51/321
4,545,157 10/1985 Saurwein ..... 51/439

FOREIGN PATENT DOCUMENTS 1393560 5/1975 United Kingdom ..... 51/439

*Primary Examiner*—Frederick R. Schmidt
*Assistant Examiner*—Robert A. Rose
*Attorney, Agent, or Firm*—B. J. Murphy

[57] ABSTRACT

The apparatus confines abrasive slurry in one chamber of a dual-chamber reservoir having a piston sealing between the two chambers. Pump-pressured water is conducted to the other chamber (a) to displace the piston and, consequently, (b) to pressure the slurry. A fluid line conveys the pressured slurry to a central, orifice-terminated, channel formed in the axial center of a nozzle, and another fluid line conveys pump-pressured water to an annular conduit, formed in said nozzle, which circumscribes the central channel. The annular conduit also terminates in an orifice. Both orifices are axially aligned, the latter one being of greater diameter than the former. Upon emerging from the aforesaid conduit and channel, the water and slurry accelerate together in a convergent chamber of the nozzle to discharge via the larger-diameter, final exit orifice.

13 Claims, 2 Drawing Figures

LIQUID/ABRASIVE JET CUTTING APPARATUS

Figure 1:
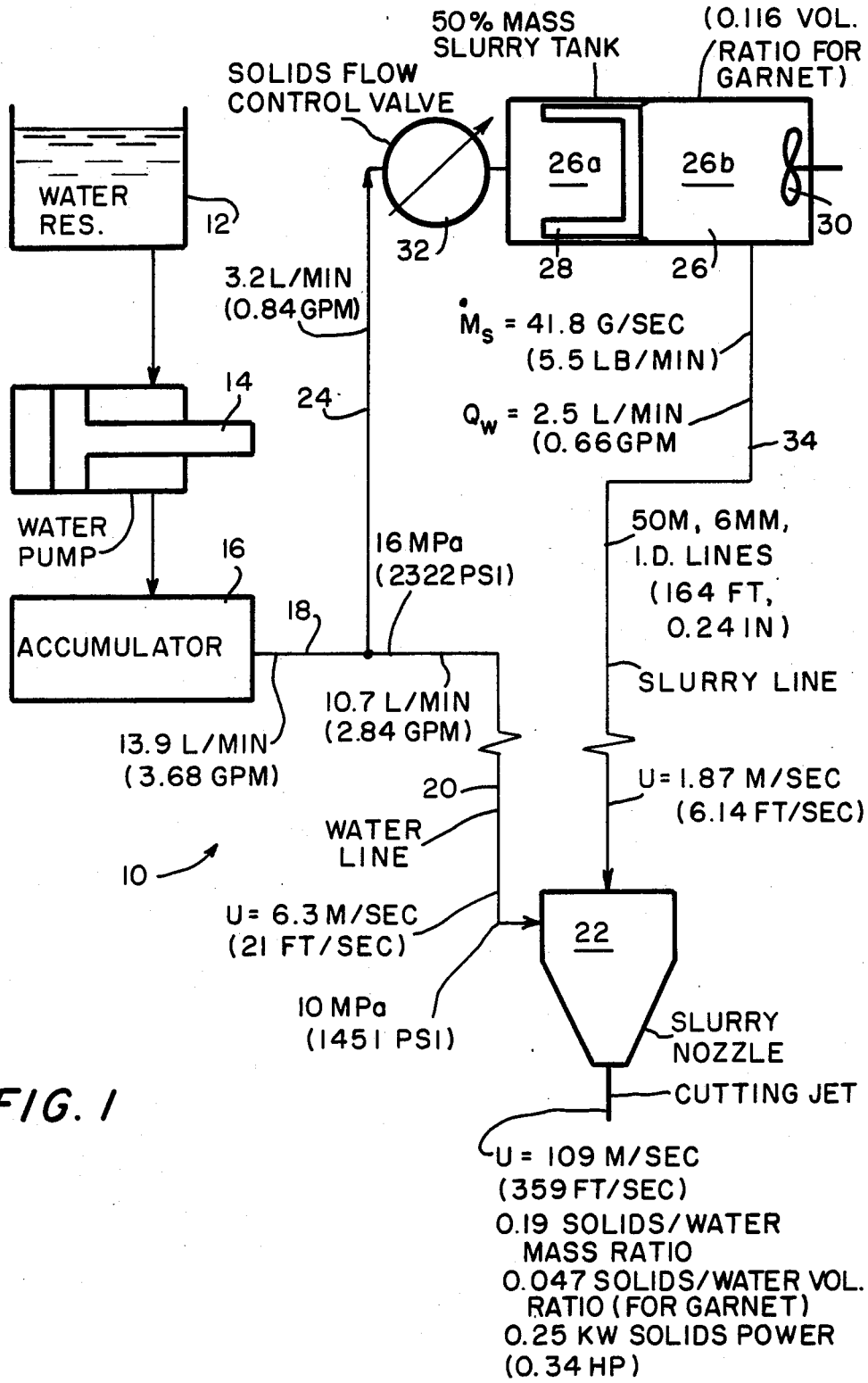

This invention pertains to water jet cutting systems and apparatus, and in particular to an improved liquid-/abrasive jet cutting apparatus.

Very high pressure water jets (200 MPa (30,000 psi) or more) have been used for many years, in water jet cutting systems, to produce fine cuts in a variety of relatively soft materials. More recently, solid particles, such as garnet or iron grit, have been used with the water jet cutting systems. Thus, abrasive jet cutting systems now in use can produce high quality cuts in glass, honeycombs, laminated materials, concrete, hard rock and steel.

The state of art or prior art abrasive jet system is an adaptation of pure water jet systems in that a very small, high speed jet is used as a jet pump to pull the solids into the abrasive jet nozzle. The water and solids are mixed in the nozzle, and it is here that the solid particles are energized. The major deficiencies of the state of the art of prior art abrasive jet system include:

1. System Cost

Components include a pressure compensated hydraulic pump, high pressure intensifier and accumulator, oil and water reservoirs, solids hopper, high pressure water lines and fittings and the nozzle or cutting head, the same constituting a considerable expense.

2. High Power Requirement

A typical system requires a significant power input of the order of 70 kw (94. h.p.) to produce a fractional kilowatt of solids energy flux or effective power output. Thus, the state of art abrasive jet system has an extraordinarily low efficiency and it is heavy and large.

3. Low Reliability and Safety

Nozzle life at desired cutting rates have proven to be only a few hours at best. Thus, uninterrupted single shift operation is not generally possible. As regards safety, this is clearly a problem which must be solved when operators are in close proximity to water lines which may contain pressures up to 400 MPa (60,000 psi).

These three major deficiencies limit the applicability of abrasive jet systems to special manufacturing processes where no other known method can produce the desired quality of cut. In addition, there are some applications where the abrasive jet system is superior due to excessive mechanical cutting blade costs and where material degradation occurs during the cutting process, as with the use of torches and (expensive) laser systems.

It is an object of this invention to set forth an improved, liquid/abrasive jet cutting apparatus which is not limited by the aforesaid deficiencies.

It is particularly an object of this invention to disclose a liquid/abrasive jet cutting apparatus comprising first means comprising a supply of liquid; a cutting-jet nozzle; second means, in fluid communication with both said supply and said nozzle, for (a) pressuring the liquid of said supply thereof, and (b) pumping such pressured liquid to said nozzle; and third means comprising a supply of slurry; wherein said second means comprises means for (c) pressuring the slurry of said supply thereof, and (d) pumping such pressured slurry to said nozzle.

Figure 2:
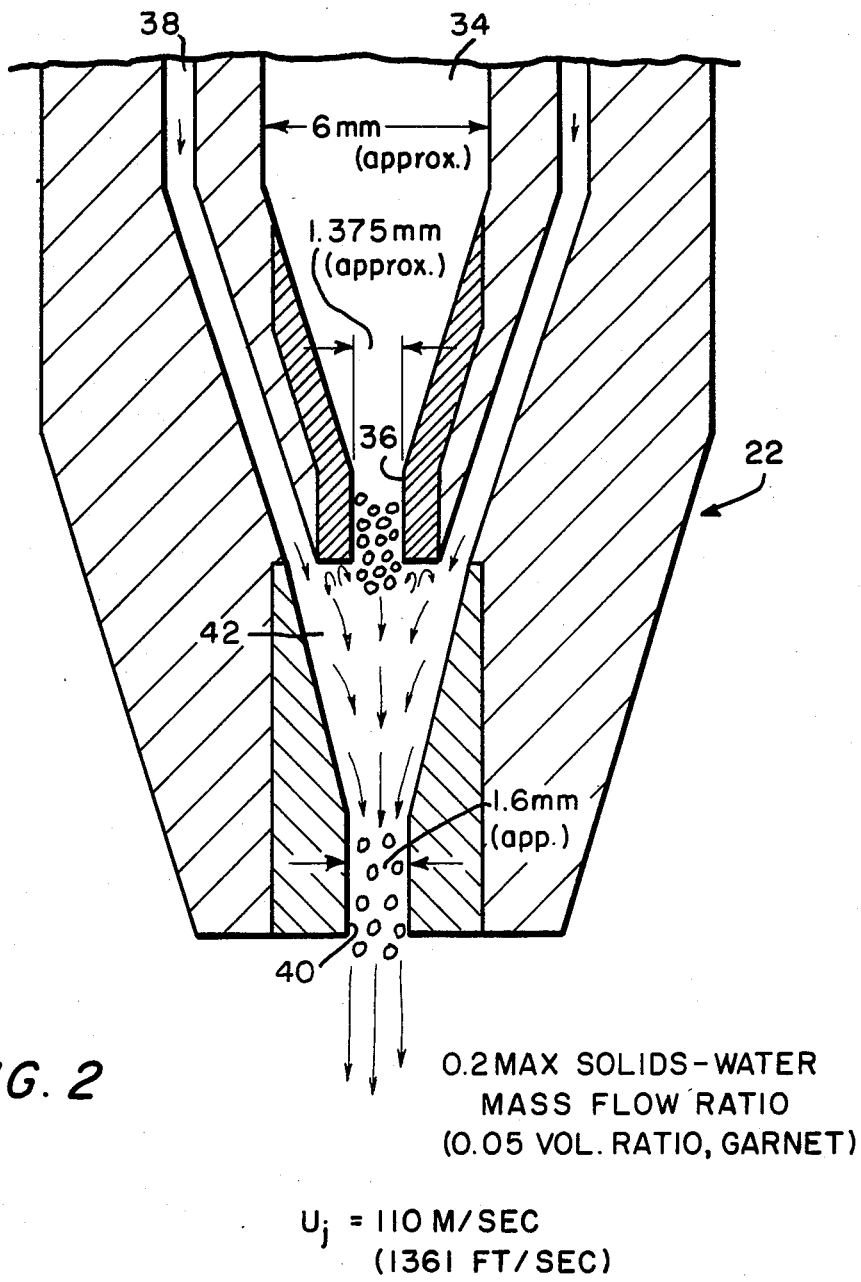

Further objects of this invention, as well as the novel features thereof, will become more apparent by reference to the following description taken in conjunction with the accompanying figures, in which:

FIG. 1 is a schematic diagram of the novel apparatus according to a preferred embodiment thereof; and FIG. 2 is a partial, cross-sectional view of the nozzle of FIG. 1, the same showing the lower, outlet portion thereof in greatly enlarged (approx. eight times greater) illustration.

As shown in the figures, the apparatus 10 comprises a water reservoir 12, supplying water to a water pump 14 which pressurizes the supplied water and conducts the latter to an accumulator 16 for collection therein and for conduction therefrom.

Fluid lines 18 and 20 convey the pressured water to a nozzle 22.

Some of the pressured water supply is shunted, via a fluid line 24, communicating with line 18, to a slurry tank 26. A piston 28, sealing disposed in the tank 26, subdivides the tank into chambers **26*a* and 26*b*. An abrasive slurry, of garnet particles and water, is confined within chamber 26*b* and agitated, to keep the particles in suspension, by a bladed agitator 30**.

A needle control valve 32 is interposed in line 24 to control the flow rate of water into chamber **26*a* and, consequently, thereby to control the slurry discharge from chamber 26*b* (pursuant to displacement of piston 28) to the nozzle 22. A fluid line 34 communicates chamber 26*b* with the nozzle 22**.

The nozzle 22 has a central, elongate channel 34 of a first diameter which, in this embodiment, is six millimeters in dimension. The channel 34 diminishes, at its exit and thereof into a jet-defining orifice 36 of a second, considerably smaller diameter. The latter is of approximately one and a third millimeter in dimension.

Nozzle 22 further has an annular, elongate conduit 38 formed therein which circumscribes the central channel 34. Conduit 38 also terminates in its exit end thereof as a jet-defining orifice 40 of a diameter (of approximately one and two-thirds millimeters) slightly larger than that of orifice 36. Orifice 40 is formed from a converging, conical chamber 42 which bridges between the annular conduit 38 and the orifice 40.

The nozzle 22 effects a preliminary acceleration of the water and the high density slurry in the diminishing-area channel 34 and the similarly diminishing area conduit 38. Thereafter the two streams meet in the conical chamber 42 and accelerate together to a nozzle exit orifice 40. The purpose of the preliminary or first stage acceleration is to produce a high density slurry exit diameter which is slightly smaller than the final exit diameter. This can be accomplished since the high density slurry volume flow rate (approx. 6.14 ft./sec. and 0.66 gpm in this embodiment) is much less than the pure water flow rate (of approx. 21 ft./sec. and 2.84 gpm). In any event, it produces a central slurry feed with a surrounding annular water flow field.

Acceleration of the two streams takes place in the convergent flow field in chamber 42 to the nozzle exit orifice 40. The final conversion of potential energy (pressure) takes place here and it is essentially as efficient as a pure water nozzle. In this connection, it is noted that the main mechanism of particle acceleration in the second stage nozzle is the hydraulic pressure gradient. Thus, the second stage of the nozzle 22, i.e., orifice 40, can be short, as shown, and relatively few of the sparse population of solid particles will be involved in high energy collisions with the wall of the exit nozzle.

The nozzle features described above cannot be achieved in the state of the art nozzles. First, in prior art nozzles solid particle acceleration occurs very inefficiently because it takes place in an essentially constant pressure field where essentially all of the ultra-high pressure water energy is wasted. Second, the state of art water nozzles are of the order of 0.06 mm (0.024 in.) in diameter. Thus, central feed of solids within an annular water jet would involve annular jets with a thickness of the order of 0.03 mm (0.0012 in.). Clearly, the nozzle to produce such an annular jet cannot be manufactured commercially.

The apparatus 10 and nozzle 22 design concept presented in this application stems from calculations which followed a recent survey of the literature on abrasive jet cutting technology. At present, it is based only on calculations, but these indicate several orders of magnitude increase in system efficiency over the present state of the art. Thus, for example, from the data presented in FIGS. 1 and 2.

Pump pressure, $P_T=16$ MPa (2322 psi)
Pump flow, $Q=13.9$ l/min (3.68 gpm)
Pump power out, $P_o=3.7$ kw (4.97 h.p.)
Solids power, $P_S=0.25$ kw (0.34 h.p.)

This data must be compared with a state of the art system at a similar solids power output:

$P_T=241$ MPa (35,000 psi)

$Q=12.5$ l/min (3.3 gpm)

$P_o=50.2$ kw (67.3 h.p.)

The hydraulic power input of the state of art system is 13.6 times that of the new system concept.

The invention is a special variation of what has been termed an "indirect pumping" system in the literature on because, as conceived, (a) it had a severe nozzle wear problem and (b) it had unsolved systems interface and control problems.

This invention does not have the latter problems. The main water pump 14, of a conventional type, is used to pressurize and pump a high density slurry to the exit nozzles 36 and 40.

The pure water and the high density slurry are separated by a simple piston 28.

The high density slurry flow, hence the net solids flow, is precisely controlled to any desired rate by one conventional variable orifice control (e.g., the needle valve 32) on the pure water side of the water-slurry tank 26.

The combination of the aforesaid features produce an apparatus 10 in which the unit area pure water flow rate through the exit nozzle orifice 40 is a constant. Thus, the valve 32 controls the solids flow rate from zero to some system maximum at constant nozzle exit velocity through the nozzle 22.

While I have described my invention in connection with a specific embodiment thereof, it is to be clearly understood that this is done only by way of example and not as a limitation to the scope of my invention, as set forth in the objects thereof and in the appended claims.

I claim:

1. Liquid/abrasive jet cutting apparatus, comprising:
a source of liquid;
a jet-cutting nozzle;
means, in fluid communication with both said source and said nozzle, for (a) pressuring liquid, and (b) pumping pressurized liquid to said nozzle; and
a source of slurry; wherein
said liquid pressurizing and pumping means comprises means for (c) pressuring slurry, and (d) pumping pressured slurry to said nozzle;
said source of slurry comprises a reservoir; and further including
means sealingly subdividing said reservoir into a pair of chambers; wherein
said subdividing means comprises a wall movably disposed in said reservoir for varying the volumes of said chambers; and
said liquid pressurizing and pumping means comprises means for conducting pressure liquid to one of said chambers of said pair for effecting, as a consequence thereof, movement of said wall within said reservoir, and a resulting, concomitant diminution of the volume of the other chamber of said pair.

2. Apparatus, according to claim 1, further including: means interposed in said conducting means for selectively controlling flow of said pressured liquid to said one chamber.

3. Apparatus, according to claim 1, wherein:
said source of liquid comprises a container of liquid; and
said liquid pressurizing and pumping means comprises (a) a pump for pressuring the liquid, (b) an accumulator in which to store pump-pressured liquid, and (c) fluid lines communicating said container with said pump, said pump with said accumulator, and said accumumulator with said nozzle.

4. Apparatus, according to claim 2, wherein:
said source of liquid comprises a container of liquid;
said liquid pressurizing and pumping means, comprises (a) a pump for pressuring the liquid, (b) an accumulator in which to store pump-pressured liquid, and (c) fluid lines communicating said container with said pump, said pump with said accumulator, and said accumulator with said nozzle; and
said flow-controlling means comprises a valve operatively interposed in one of said lines.

5. Apparatus, according to claim 1, further including: means within said other chamber for agitating contents therein.

6. Apparatus, according to claim 1, wherein:
said other chamber comprises means for confining therewithin slurry from said source thereof;
said conducting means comprises a fluid line communicating said liquid pressurizing and pumping means with said one chamber; and further including
means interposed in said fluid line for selectively controlling flow of said pressured liquid to said one chamber.

7. Apparatus, according to claim 1, wherein:
said other chamber comprises means for confining therewithin slurry from said source thereof;
said conducting means comprises a first fluid line communicating said liquid pressurizing and pumping means with said one chamber;
said liquid pressurizing and pumping means further comprises a second fluid line, for conducting slurry therethrough, communicating said other chamber with said nozzle; and further including
means interposed in one of said fluid lines for selectively controlling flow of slurry through said second fluid line from said other chamber.

8. Apparatus, according to claim 7, wherein:

said nozzle has a central, elongate channel, formed therein, of a first diameter which diminishes, at an exit end thereof, in a given jet-defining orifice of a second diameter which is considerably smaller than said first diameter;

said nozzle further has an annular, elongate conduit, formed therein, circumscribing said central channel;

said second fluid line is in fluid communication with said central channel; and said liquid pressurizing and pumping means further comprises means effecting fluid communication thereof with said annular conduit.

9. Apparatus, according to claim 8, wherein:

said annular conduit (a) has a given, greatest, cross-sectional area, (b) progressively diminishes, toward an exit end thereof, into another, smallest cross-sectional area, and (c) terminates at said exit end thereof in another, jet-defining orifice.

10. Apparatus, according to claim 9, wherein:

said given and another orifices are of differing diameters.

11. Apparatus, according to claim 9, wherein:

said given orifice is of smaller diameter than that of said another orifice.

12. Apparatus, according to claim 9, wherein:

said annular conduit transforms into a converging, conical chamber, and said conical chamber transforms into said another orifice.

13. Apparatus, according to claim 12, wherein:

said given orifice has a termination which opens onto said conical chamber.

* * * * *